US010727612B2

(12) United States Patent
Shimada et al.

(10) Patent No.: US 10,727,612 B2
(45) Date of Patent: Jul. 28, 2020

(54) CRIMP TERMINAL, ELECTRICAL WIRE WITH TERMINAL, AND MANUFACTURING METHOD FOR ELECTRICAL WIRE WITH TERMINAL

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Takanobu Shimada, Mie (JP); Kenji Miyamoto, Mie (JP); Naoya Nishimura, Mie (JP); Yoshikazu Hachiya, Mie (JP)

(73) Assignees: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-Shi, Osaka (JP)

( * ) Notice: Subject to any disclaimer, the term of this patent is extended or adjusted under 35 U.S.C. 154(b) by 138 days.

(21) Appl. No.: 15/815,284

(22) Filed: Nov. 16, 2017

(65) Prior Publication Data

US 2018/0145426 A1 May 24, 2018

(30) Foreign Application Priority Data

Nov. 24, 2016 (JP) ..... 2016-227611

(51) Int. Cl.
*H01R 4/18* (2006.01)
*H01B 1/02* (2006.01)
(Continued)

(52) U.S. Cl.
CPC ..... *H01R 4/185* (2013.01); *H01B 1/023* (2013.01); *H01R 4/188* (2013.01); *H01R 4/20* (2013.01);
(Continued)

(58) Field of Classification Search
CPC ..... H01B 1/023; H01R 11/12; H01R 43/048; H01R 4/185; H01R 4/188; H01R 4/20
See application file for complete search history.

(56) References Cited

U.S. PATENT DOCUMENTS 3,243,758 A * 3/1966 Frant ..... H01R 43/058 439/519
3,643,008 A * 2/1972 Brazee ..... H01B 9/028 174/107
(Continued)

FOREIGN PATENT DOCUMENTS

JP 2009123621 A * 6/2009
JP 5741409 B 5/2015

*Primary Examiner* — William H. Mayo, III
*Assistant Examiner* — Rhadames Alonzo Miller
(74) *Attorney, Agent, or Firm* — Reising Ethington, P.C.

(57) ABSTRACT

A crimp terminal may include: a receiving portion that is to receive conductor portions of electrical wires and has an end portion from which the electrical wires are to be lead out; a pair of first barrel portions that are connected to the receiving portion and compress the conductor portions along with the receiving portion; a bend portion that extends from an end portion of the receiving portion and is bent so as to be folded over; and an overlap portion that is connected to the bend portion and overlaps the receiving portion.

5 Claims, 27 Drawing Sheets

(51) Int. Cl.

| | |
|---|---|
| ***H01R 4/20*** | (2006.01) |
| ***H01R 4/62*** | (2006.01) |
| ***H01R 13/11*** | (2006.01) |
| ***H01R 43/048*** | (2006.01) |
| ***H01R 11/12*** | (2006.01) |

(52) U.S. Cl.
CPC ..... *H01R 4/62* (2013.01); *H01R 13/11* (2013.01); *H01R 43/048* (2013.01); *H01R 11/12* (2013.01)

(56) References Cited

U.S. PATENT DOCUMENTS

| | | | | | |
|---|---|---|---|---|---|
| 3,762,939 | A * | 10/1973 | Hunter | B05D 7/16 | 428/215 |
| 5,281,762 | A * | 1/1994 | Long | H01R 9/0515 | 174/117 F |
| 2001/0003688 | A1* | 6/2001 | Kondo | B29C 45/14426 | 439/604 |
| 2010/0018768 | A1* | 1/2010 | Takahashi | H01R 4/183 | 174/74 R |
| 2010/0282494 | A1* | 11/2010 | Horiike | H01B 7/0009 | 174/115 |
| 2010/0294534 | A1* | 11/2010 | Mihara | C22C 9/06 | 174/126.1 |
| 2011/0024157 | A1* | 2/2011 | Sugimura | H01B 7/361 | 174/112 |

* cited by examiner

CRIMP TERMINAL, ELECTRICAL WIRE WITH TERMINAL, AND MANUFACTURING METHOD FOR ELECTRICAL WIRE WITH TERMINAL

CROSS REFERENCE TO RELATED APPLICATIONS

This application claims the priority of Japanese patent application JP2016-227611 filed on Nov. 24, 2016, the entire contents of which are incorporated herein.

TECHNICAL FIELD

The present specification relates to technology for crimping a crimp terminal to an electrical wire.

BACKGROUND ART

Conventionally, technology for crimping a crimp terminal to an electrical wire is known. A terminal fitting disclosed in JP5741409B includes a bottom plate and a pair of wire barrels, and an extension piece that extends from a side edge of the bottom plate has a second barrel portion that overlaps the bottom plate and the pair of wire barrels, and a connection portion that is folded back from the bottom plate and is connected to the second barrel portion. When an electrical wire is crimped, the portion of the core wire that is crimped on the second barrel portion and the connection portion is a high-compressed portion in which compression is high due to thickness of the second barrel portion and the connection portion, and therefore the oxide films on the surfaces of the element wires become ruptured and electrical resistance decreases. However, the portions of the core wire arranged on other regions of the bottom plate are low-compression portions in which compression is low, and therefore in these portions, the ability to hold the electrical wire is ensured while also preventing element wire breakage.

JP 5741409B is an example of related art.

SUMMARY

In the configuration disclosed in JP 5741409B, the extension piece extends from a side edge of the bottom plate, and therefore laying the second barrel portion and the connection portion over the bottom plate requires the connection portion to be folded over in a direction oblique to the extending direction of the electrical wire, and there is a problem in that the shape of the terminal fitting tends to be complex.

The technology disclosed in the present specification was achieved in light of the foregoing circumstances, and an object is to simplify the configuration of a crimp terminal.

A crimp terminal disclosed in the present specification includes: a receiving portion that is to receive a conductor portion of an electrical wire, and has an end portion from which the electrical wire is to be lead out; a pair of first barrel portions that are connected to the receiving portion and are to crimp the conductor portion along with the receiving portion; a bend portion that extends from the end portion of the receiving portion and is to be bent so as to be folded over; and an overlap portion that is connected to the bend portion and is to be placed over the receiving portion.

A crimp terminal manufacturing method disclosed in the present specification is a manufacturing method for an electrical wire with a terminal that includes an electrical wire and a crimp terminal, the electrical wire having a conductor portion, and the crimp terminal having a receiving portion and a pair of first barrel portions, the receiving portion receiving the conductor portion and having an end portion from which the electrical wire is lead out, and the pair of first barrel portions crimping the conductor portion along with the receiving portion, wherein in the manufacturing method, an overlap portion that extends from an end portion of the receiving portion on a side on which the electrical wire is lead out is folded over to form a bend portion, and the conductor portion of the electrical wire is crimped in a state where the overlap portion overlaps the receiving portion.

According to the above configuration, the bend portion extends from the end portion of the receiving portion on the side from which the electrical wire is lead out, and therefore it is possible to shorten the path of the bend portion and the overlap portion compared to a configuration in which, for example, the bend portion is folded over in a bypass manner from the end portion of the receiving portion on the side on which the electrical wire is not lead out. Accordingly, it is possible to simplify the configuration of the crimp terminal.

The following aspects are preferable as embodiments of the technology disclosed in the present specification.

The overlap portion has an extension portion that is connected to and extends from the bend portion, and a second barrel portion that extends in a direction that intersects the extension portion, and a portion of the receiving portion that is connected to the bend portion bulges outward relative to a portion of the receiving portion that is overlapped by the second barrel portion.

In the case of crimping the electrical wire, it is preferable that the end portion of the crimp terminal from which the electrical wire is lead out does not highly compress the conductor portion, thus suppressing damage to the conductor portion and ensuring force for holding the electrical wire, and it is preferable that a portion of the crimp terminal other than the end portion from which the electrical wire is lead out highly compresses the conductor portion on the receiving portion, thus ensuring electrical connection between the conductor portion and the crimp terminal. However, with a configuration in which the bend portion extends from the end portion on the side where the electrical wire is lead out, it is not easy to sharply fold over the bend portion from the upper side, and a slightly bulging shape is formed on the upper side (conductor portion side). In this case, there is concern that due to the bulge (protruding portion) on the upper side of the bend portion, the conductor portion will become highly compressed in this portion, and the force for holding the electrical wire will decrease due to damage to the conductor portion. According to the above configuration, the portion of the receiving portion that is connected to the bend portion bulges downward relative to the portion of the receiving portion that is overlapped by the second barrel portion, and therefore the compression rate can be set higher in the portion of the conductor portion that is placed on the bend portion than in the portion that is placed on the second barrel portion. Accordingly, it is possible to suppress damage to the conductor portion and also suppress a reduction in the force for holding the electrical wire.

The overlap portion has an extension portion that is connected to and extends from the bend portion, and a second barrel portion that extends in a direction that intersects the extension portion, and a thickness of the bend portion is smaller than a thickness of a portion of the receiving portion that is overlapped by the second barrel portion.

According to this configuration, the portion of the conductor portion that is arranged on the bend portion can be compressed less, thus making it possible to suppress a reduction in the force for holding the electrical wire caused by damage to the portion of the conductor portion that is on the bend portion.

Conductor portions of a plurality of the electrical wires are crimped between the receiving portion and the pair of first barrel portions.

In the case where the crimp terminal has a splice structure for connecting a plurality of electrical wires to each other, the electrical wires are lead out from the two end portions of the receiving portion, and therefore the conductor portions of the electrical wires are easily placed on the bend portion. According to the above configuration, it is possible to simplify the configuration of this crimp terminal that has a splice structure.

An electrical wire with a terminal according to an aspect of the present specification includes: an electrical wire and the above crimp terminal, a conductor portion of the electrical wire being crimped between the receiving portion and the pair of first barrel portions.

The overlap portion has an extension portion that is connected to and extends from the bend portion, and a second barrel portion that extends in a direction that intersects the extension portion, the crimp terminal is placed on a lower die in a state where the conductor portion is placed on the receiving portion, and the crimp terminal is clamped between and crimped by the lower die and an upper die, and the lower die has a first press portion for mounting and pressing a portion of the receiving portion that is overlapped by the second barrel portion, and a second press portion that is at a lower position than the first press portion and is for mounting and pressing a portion of the receiving portion that is overlapped by the extension portion.

According to this configuration, the portion of the conductor portion that is arranged on the extension portion can be compressed less than the portion of the conductor portion that is arranged on the second barrel portion, thus making it possible to suppress damage to the portion of the conductor portion that is on the extension portion.

According to the technology disclosed in the present specification, it is possible to simplify the configuration of a crimp terminal.

EMBODIMENTS

First Embodiment

Figure 1:
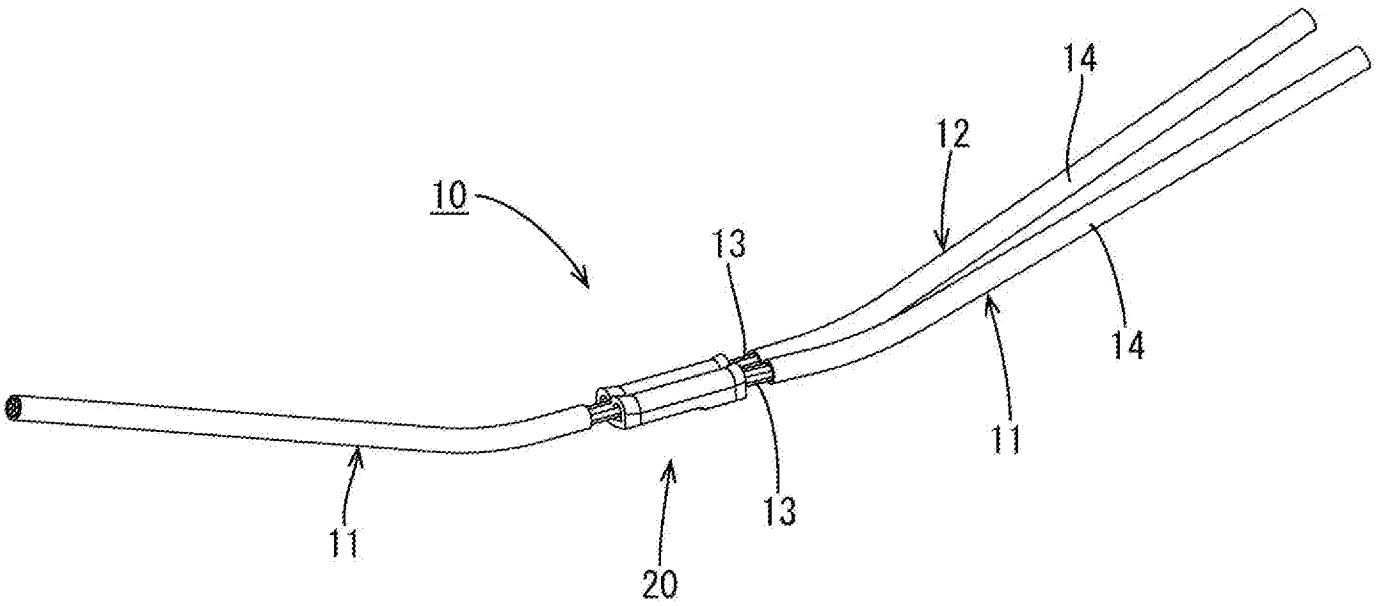
FIG. 1 is a perspective view of an electrical wire with a terminal according to a first embodiment.

A first embodiment will be described below with reference to FIGS. 1 to 15C. As shown in FIG. 1, an electrical wire with a terminal 10 of the present embodiment includes two electrical wires 11 and 12, one of which is a main line 11 and the other of which is a branch line 12, and the electrical wires 11 and 12 are crimped by a splice terminal that is a crimp terminal 20.

Electrical Wires 11, 12

The electrical wires 11 and 12 both have a metal conductor portion 13 and an insulating coating 14 that is made of a synthetic resin and covers the conductor portion 13. The conductor portion 13 is constituted by a stranded wire in which many (a plurality of) metal element wires made of aluminum, an aluminum alloy, or the like are twisted together. The insulating coating 14 is removed from a portion of the main line 11 that has a predetermined length and includes the portion to be crimped by the crimp terminal 20, thus exposing the conductor portion 13. The insulating coating 14 is also removed from a terminal portion of the branch line 12 to expose the conductor portion 13. The conductor portion 13 exposed from the main line 11 and the conductor portion 13 exposed in the terminal portion of the branch line 12 are arranged side-by-side with their outer circumferential surfaces in contact with each other, and the crimp terminal 20 is crimped thereto so as to be wrapped around, thus electrically connecting the main line 11 and the branch line 12.

Crimp Terminal 20

Figure 2:
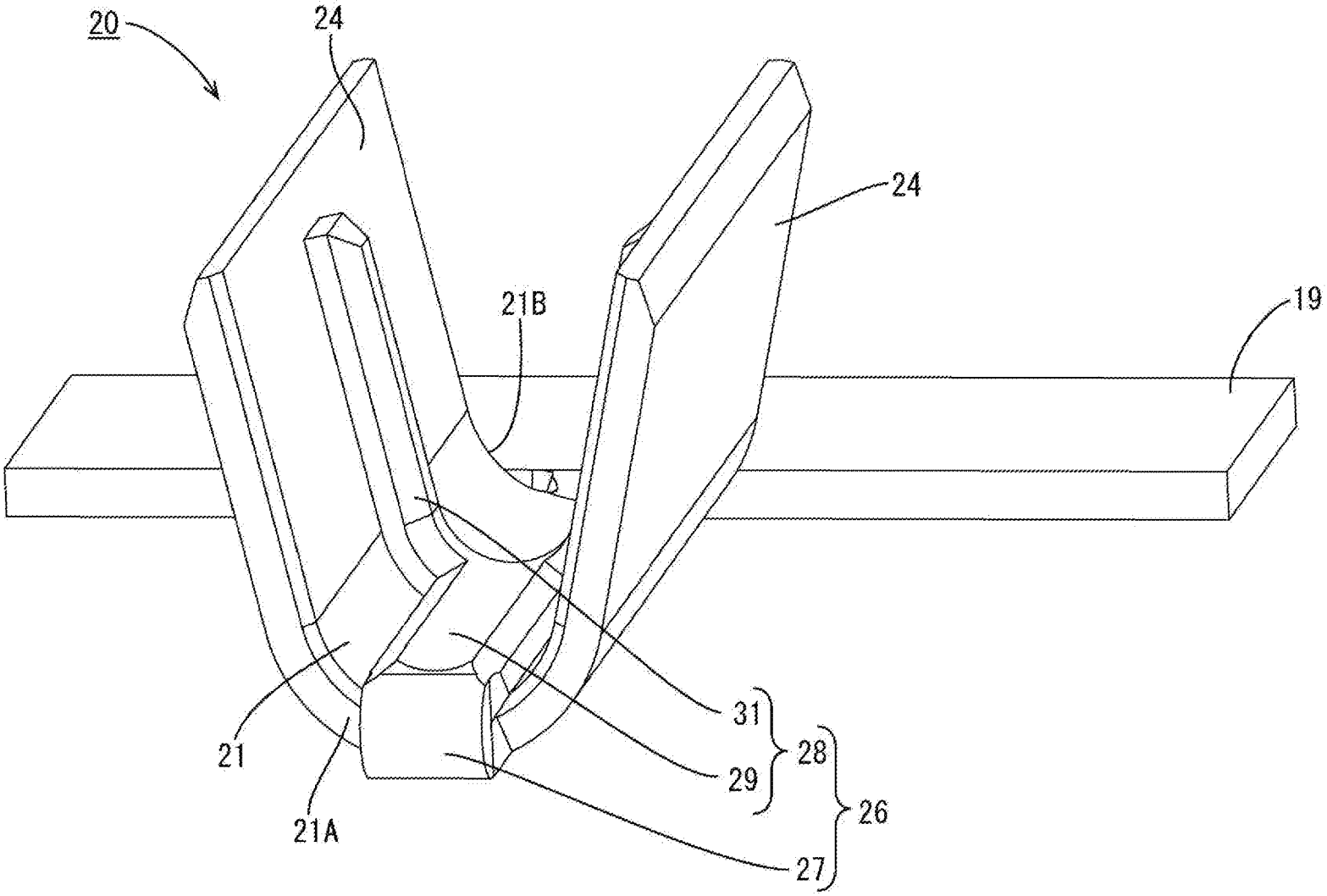
FIG. 2 is a perspective view of a crimp terminal.
Figure 3:
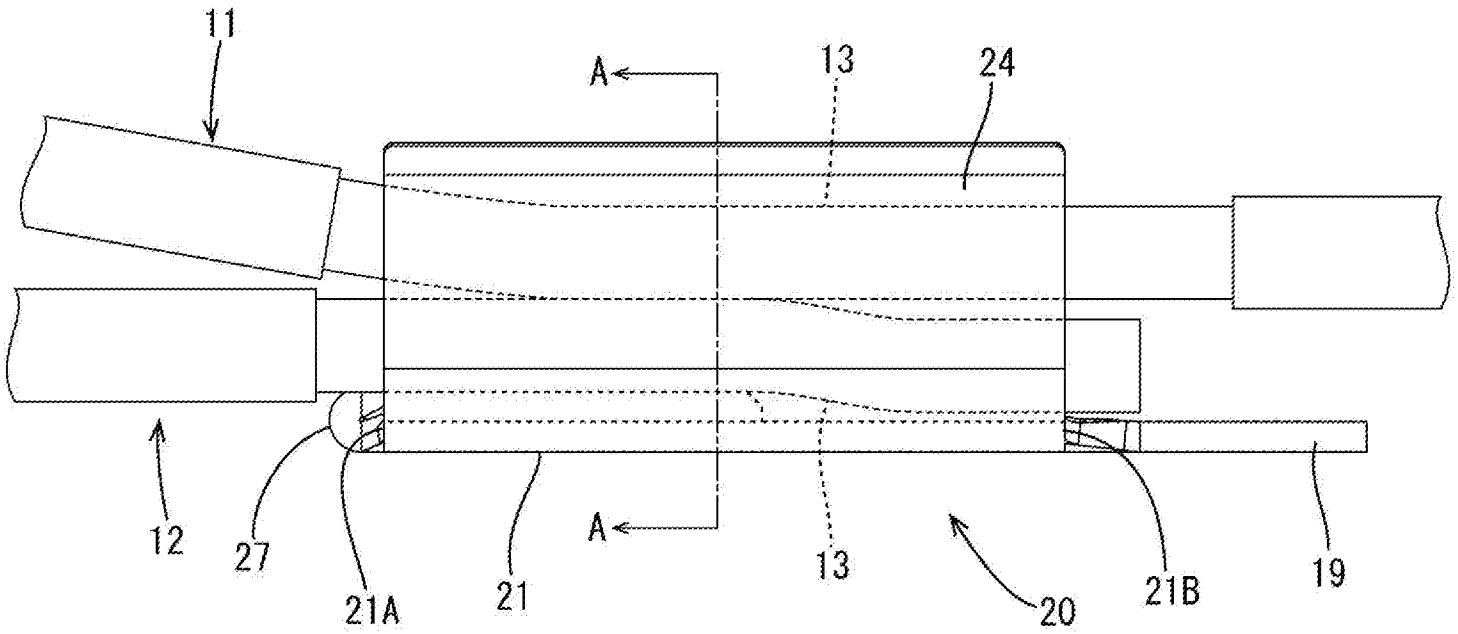
FIG. 3 is a side view of a state where a main line and a branch line are placed on the crimp terminal.
Figure 4:
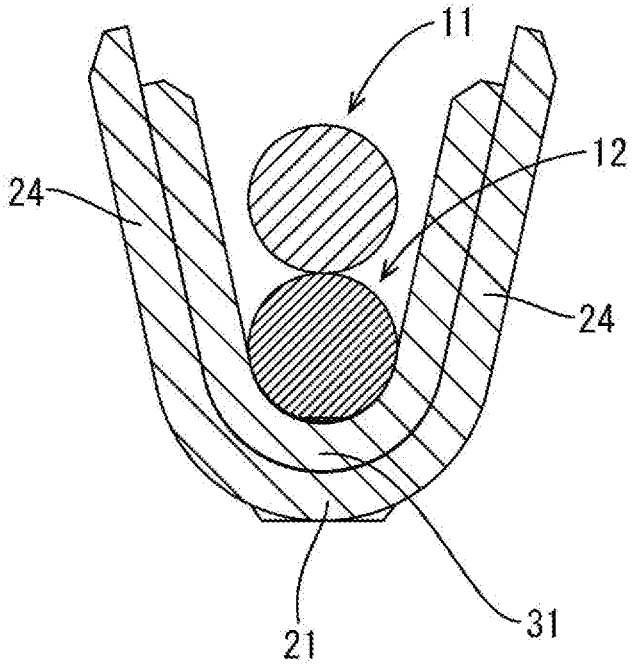
FIG. 4 is a cross-sectional view taken along A-A in FIG. 3.

The crimp terminal 20 is made of copper or a copper alloy, for example, and is plated with tin. As shown in FIG. 2, the crimp terminal 20 includes a U-shaped receiving portion 21 for receiving the conductor portions 13 of the electrical wires 11 and 12, a pair of first barrel portions 24 that are connected to the left and right sides of the receiving portion 21 and are for crimping the conductor portions 13 along with the receiving portion 21, and a fold-over piece 26 that is connected to one end portion 21A of the receiving portion 21 and is for being folded over, and these members are formed integrally.

The receiving portion 21 has a curved shape of being concave such that the conductor portions 13 can be placed thereon. At the one end portion 21A of the receiving portion 21 in the front-rear direction (electrical wire extending direction), the main line 11 and the branch line 12 arranged on the receiving portion 21 are lead to the outside, and at the other end portion 21B, the conductor portion 13 of the main line 11 and the conductor portion 13 (tip portion) of the branch line 12 are lead to the outside.

The pair of first barrel portions 24 are connected to respective sides of the receiving portion 21, and extend in a flat plate shape diagonally upward before being crimped. After crimping, the pair of first barrel portions 24 curve so as to be wrapped inward, and crush and compress the conductor portions 13 of the main line 11 and the branch line 12. Note that the position where the first barrel portions 24 cut into the conductor portions 23 can be set such that the first barrel portions 24 cut into the conductor portions 13 of both the main line 11 and the branch line 12, but there is no limitation to this, and the first barrel portions 24 may cut into a boundary portion between the main line 11 and the branch line 12.

The fold-over piece 26 includes a bend portion 27 that extends forward from the end portion 21A of the receiving portion 21 and is bent so as to be folded over rearward, and an overlap portion 28 that is connected to the bend portion 27 and overlaps the receiving portion 21. The bend portion 27 is curved in a U shape and is connected to the overlap portion 28 that overlaps the receiving portion 21 and extends parallel with the receiving portion 21. The overlap portion 28 includes an extension portion 29 that extends in a strip shape rearward from the bend portion 27, and a second barrel portion 31 that is connected to the end portion of the extension portion 29 and extends in a direction that is orthogonal to (a direction that intersects) the extension portion 29. The extension portion 29 extends in a straight line with a predetermined width, and connects the bend portion 27 and the second barrel portion 31 to each other.

Figure 15A:
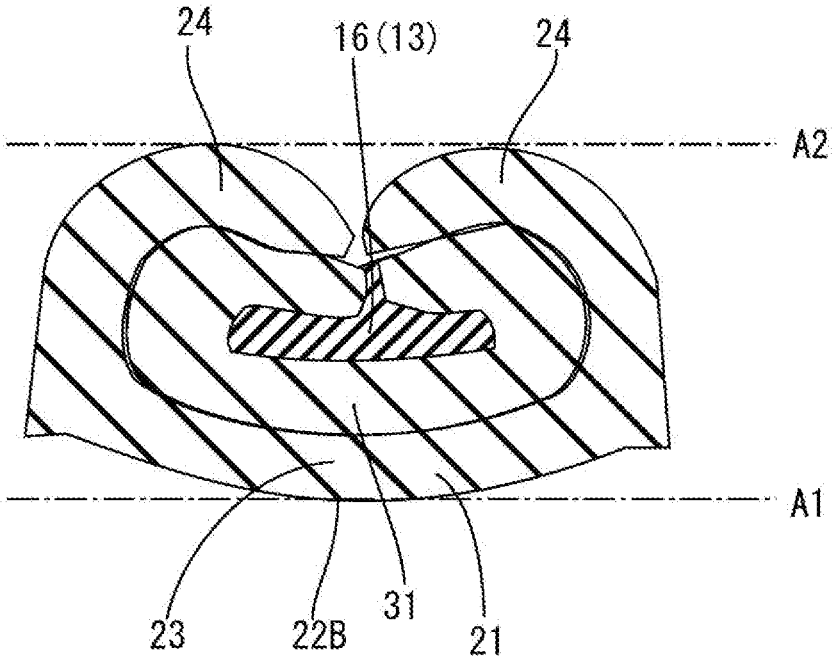
FIG. 15A is a cross-sectional view taken along C-C in FIG. 14.

When the second barrel portion 31 protrudes toward the conductor portions 13 relative to the receiving portion 21 as shown in FIG. 15A, it forms a high-compression portion 16 in which the conductor portions 13 are compressed with a low compression rate (conductor portions are densely compressed). Note that the compression rate is defined as (sectional area of core wire after compression)/(section area of core wire before compression)×100(%). In other words, the smaller the value of the compression rate is, the higher the conductor portions 13 are compressed, and the denser the state is. In the high-compression portion 16, the oxide films formed on the surfaces of the conductor portions 13 are ruptured to expose new metal surfaces, thus lowering contact resistance between the conductor portion 13 of the main line 11 and the conductor portion 13 of the branch line 12, and lowering contact resistance between the conductor portions 13 and the receiving portion 21 and first barrel portions 24.

Figure 14:
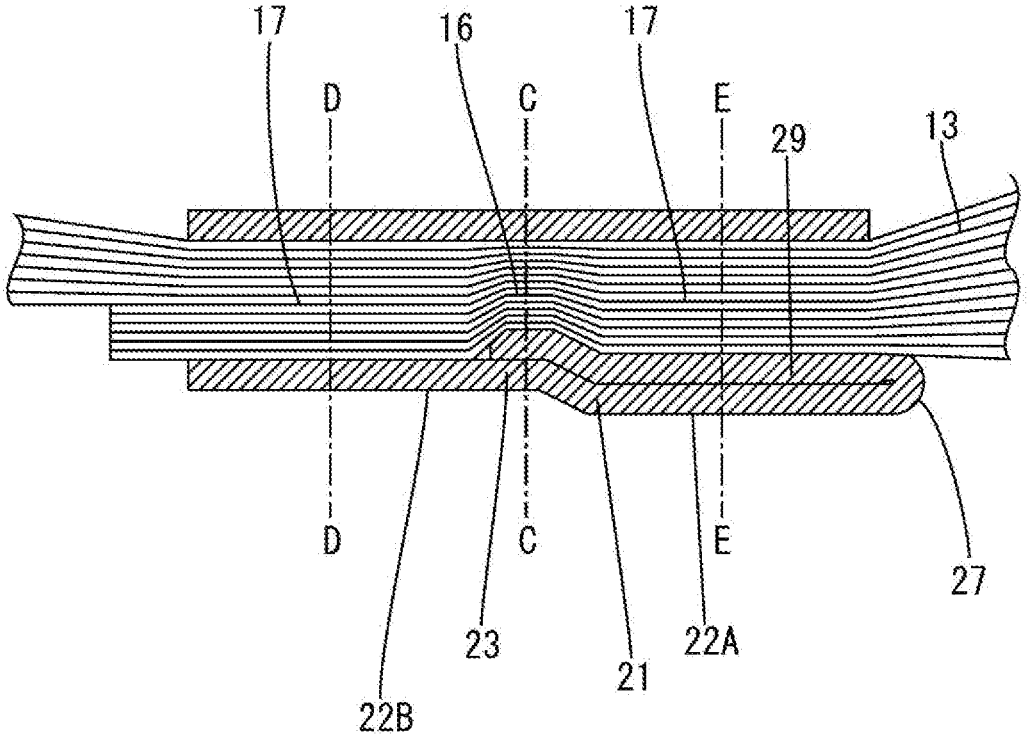
FIG. 14 is a longitudinal sectional view of the electrical wire with a terminal.
Figure 15B:
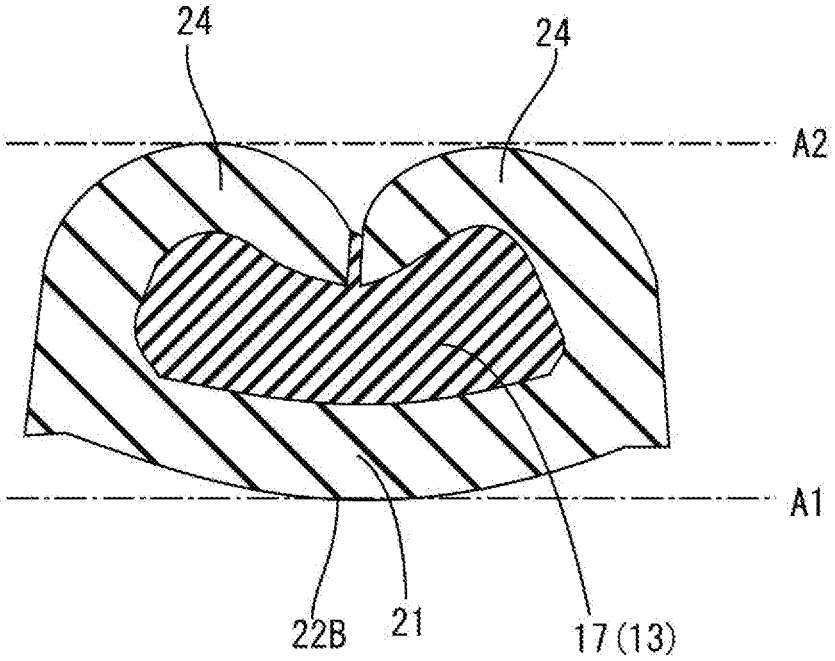
FIG. 15B is a cross-sectional view taken along D-D in FIG. 14.
Figure 15C:
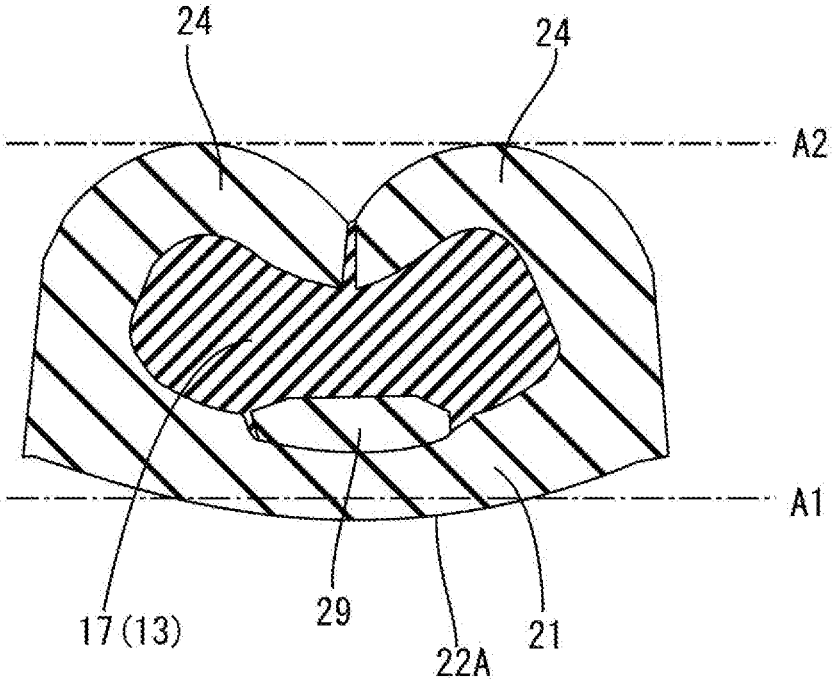
FIG. 15C is a cross-sectional view taken along E-E in FIG. 14.
Figure 16:
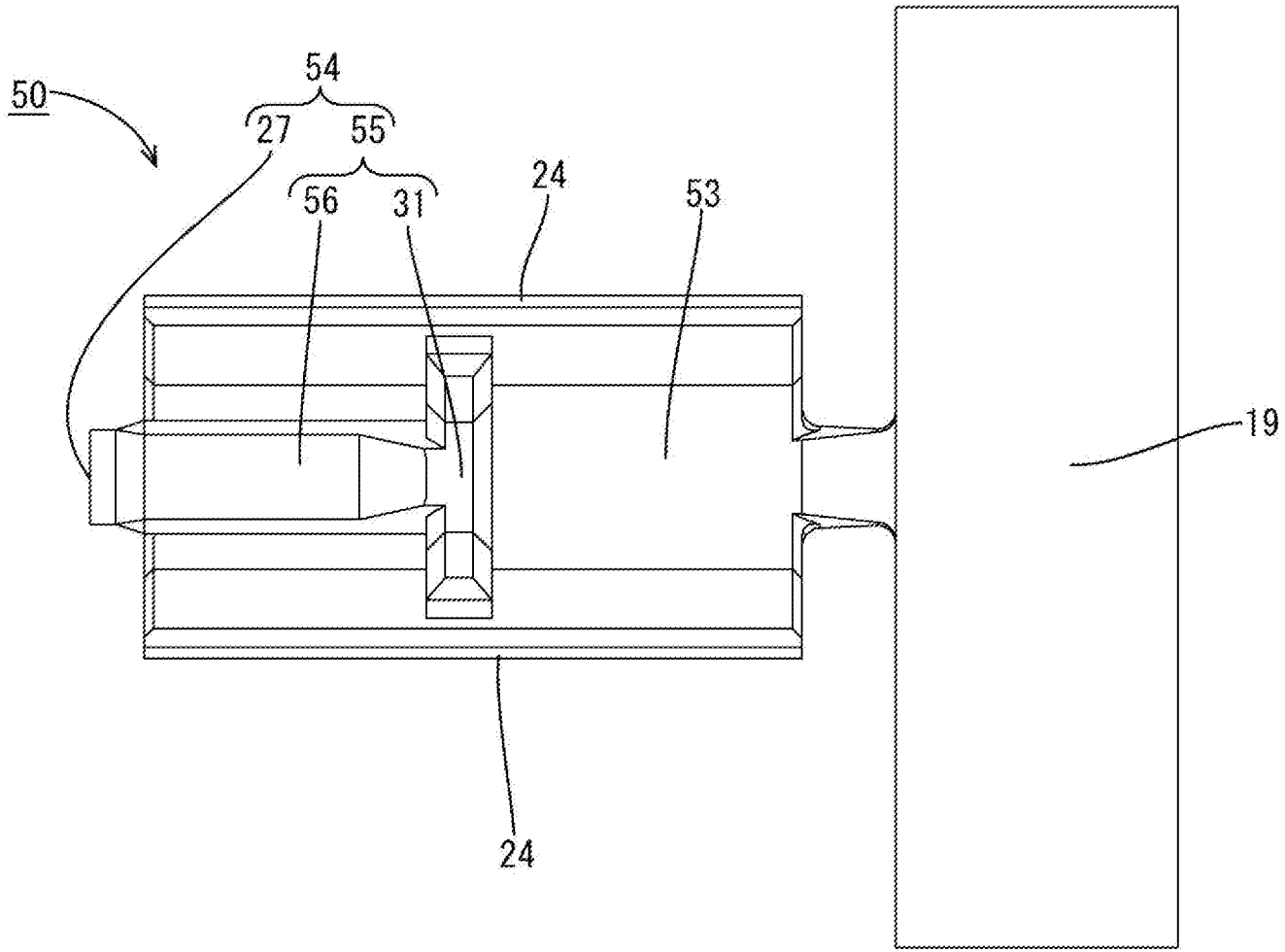
FIG. 16 is a plan view of a crimp terminal according to a second embodiment.
Figure 17:
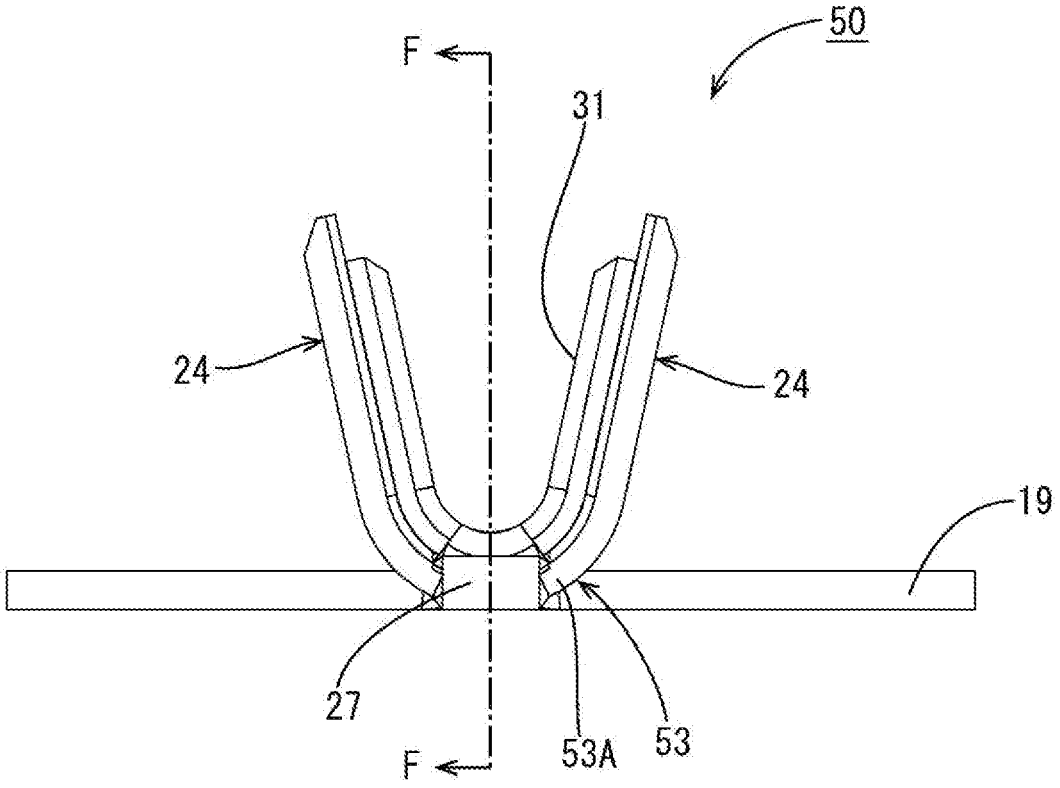
FIG. 17 is a front view of the crimp terminal.

As shown in FIGS. 15B and 15C, in a low-compression portion 17, portions of the conductor portions 13 that are not compressed by the second barrel portion 31 are compressed with a higher compression rate than in the high-compression portion 16. In the low-compression portion 17, the compression rate is high, and therefore breakage of the element wires of the conductor portions 13 is suppressed, favorable tensile strength is ensured for the conductor portions 13, and it is possible to improve the force with which the conductor portions 13 are held by the crimp terminal 20. As shown in FIGS. 14 and 15C, the bottom surface of the roughly front half portion (portion including at least the portion connected to the bend portion 27) of the compressed receiving portion 21 is a bulging portion 22A that bulges downward (outward) relative to a bottom surface 22B of the roughly rear half portion (portion including a barrel overlap region 23 that is overlapped by the second barrel portion 31). In FIGS. 15A to 15C, an upper end position A2 of the cross-section of the crimp terminal 20 is at the same position, but the lower end position of the bulging portion 22A is below a position A1.

Figure 6:
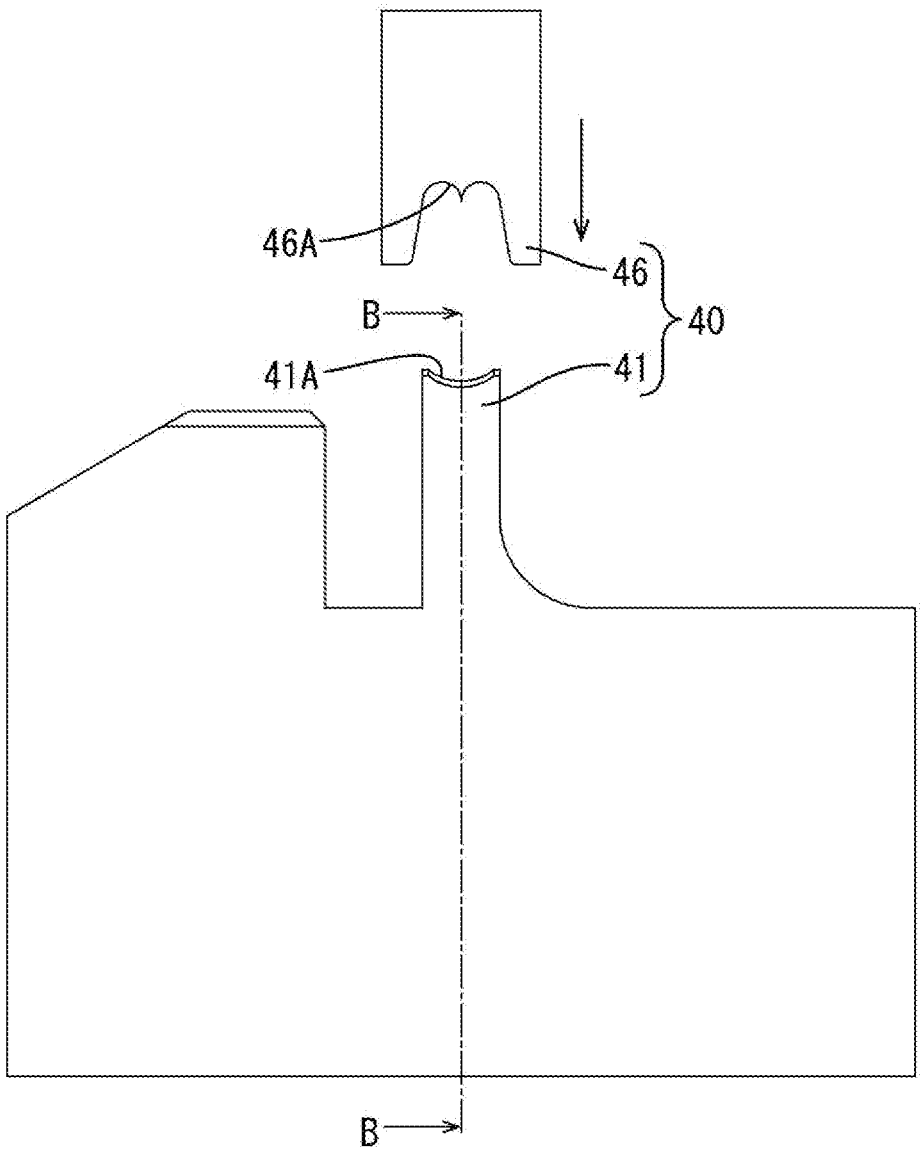
FIG. 6 is a front view of a die.
Figure 7:
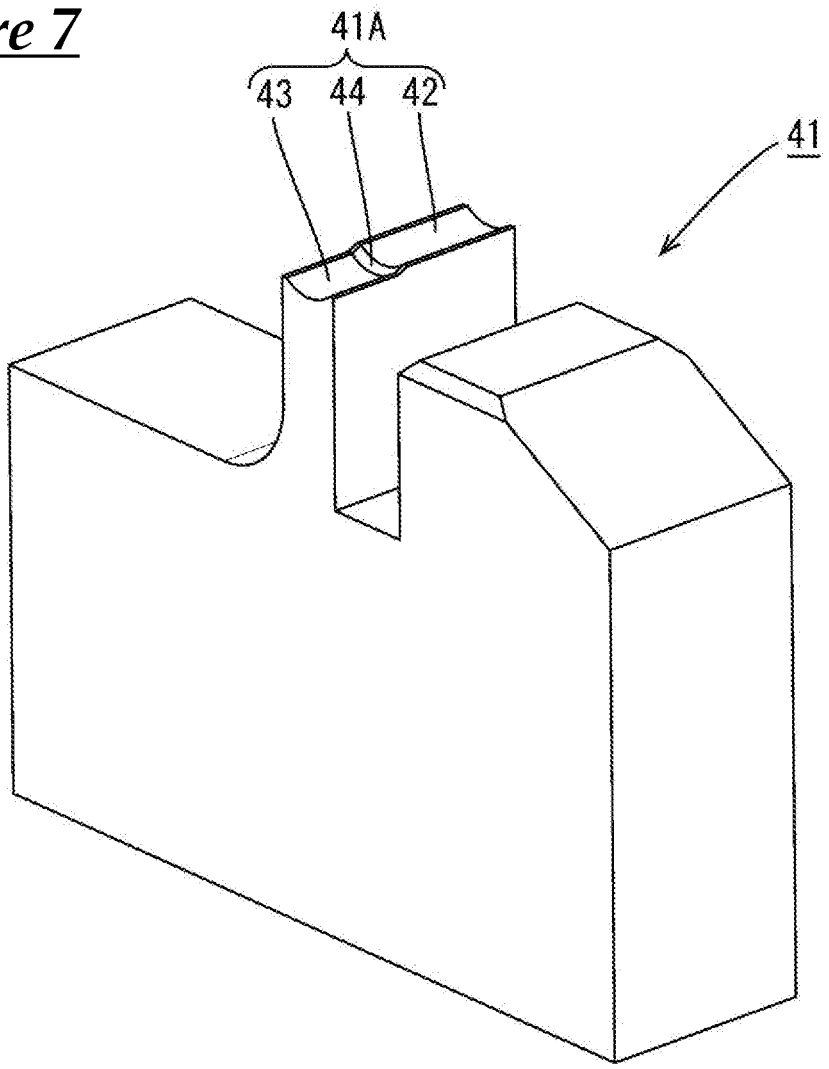
FIG. 7 is a perspective view of a lower die.
Figure 8:
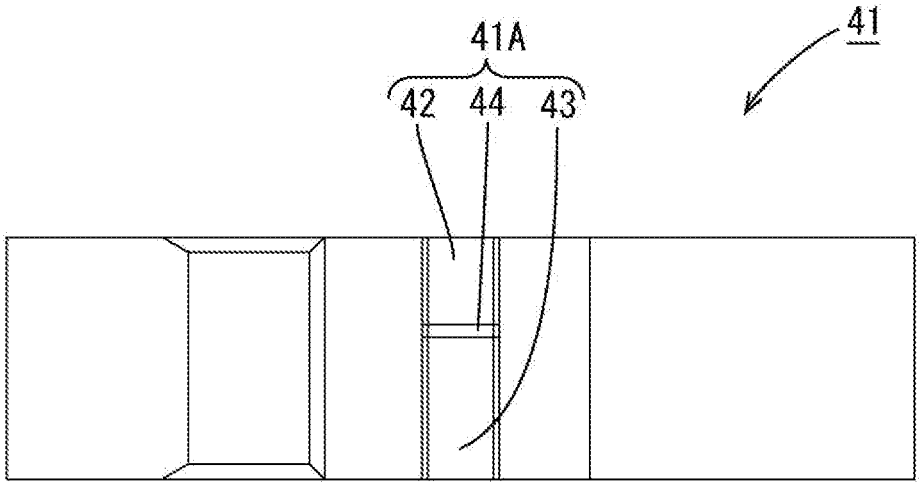
FIG. 8 is a plan view of the lower die.
Figure 9:
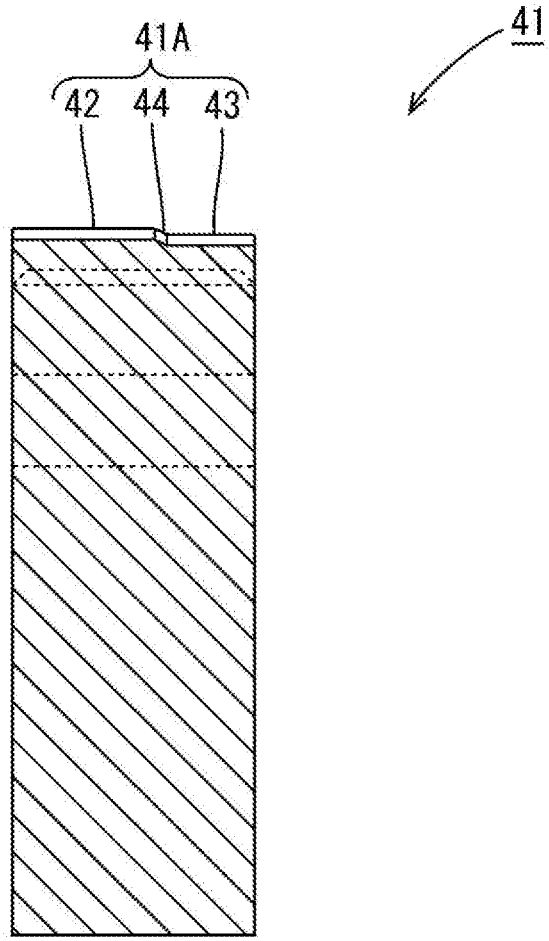
FIG. 9 is a cross-sectional view taken along B-B in FIG. 6.

As shown in FIG. 6, the electrical wires 11 and 12 and the crimp terminal 20 are crimped together by a die 40. The die 40 includes a lower die 41 on which the crimp terminal 20 is placed, and an upper die 46 that is lowered toward the lower die 41 and deforms the first barrel portions 24. The upper die 46 has a mountain-shaped recessed portion 46A on the bottom surface side along which the pair of first barrel portions 24 can slide and undergo deformation. The recessed portion 46A has the same cross-sectional shape over the entire length in the front-rear direction. The lower die 41 has a placement surface 41A that is recessed in a circular arc shape, and the crimp terminal 20 is placed on the placement surface 41A. As shown in FIG. 7, the placement surface 41A has a first press portion 42 at a high position and on which the crimp terminal 20 is placed, a second press portion 43 at a lower position than the first press portion 42 and on which the crimp terminal 20 is placed, and a level difference portion 44 that connects the first press portion 42 and the second press portion 43 in a step-like manner.

The first press portion 42 is at a height at which the high-compression portion 16 can be formed, and the second press portion 43 is at a height at which the low-compression portion 17 can be formed. The level difference portion 44 has an inclined surface that is inclined at an obtuse angle to the first press portion 42 and the second press portion 43.

Next, a manufacturing method for the electrical wire with a terminal 10 will be described.

Figure 5:
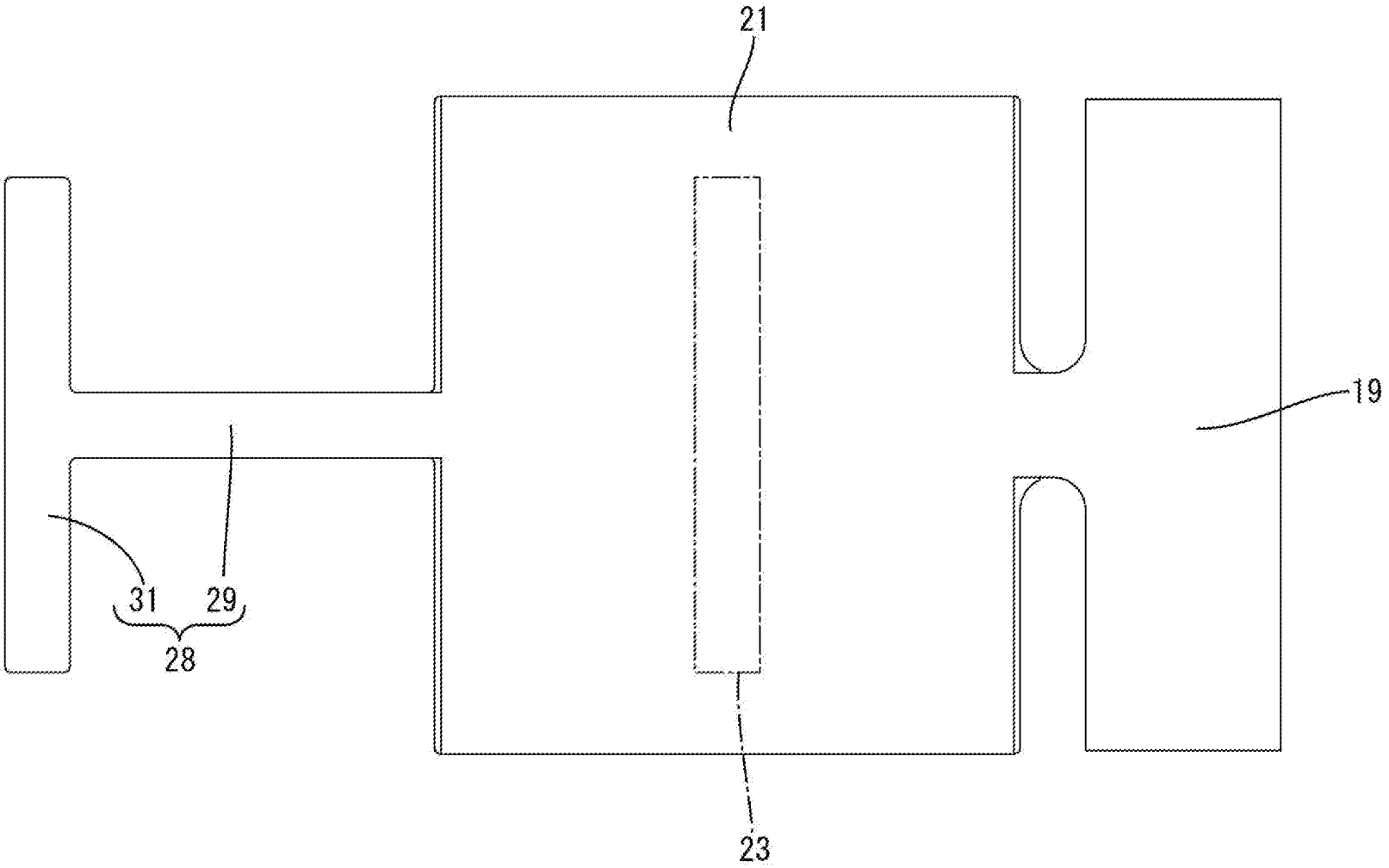
FIG. 5 is an expansion view of the crimp terminal.

For example, a presser is used to punch a metal plate so as to form a terminal chain in which a plurality of crimp terminals in an expansion state are connected by belt-shaped carriers 19 as shown in FIG. 5. By then performing bending processing and a cutting step of cutting the connection portions of the carriers 19, it is possible to form the crimp terminal 20. Also, the fold-over piece 26 is folded over toward the receiving portion 21, and the second barrel portion 31 is placed on the barrel overlap region 23 of the receiving portion 21. Note that the carriers 19 may be cut after crimping, or may be left remaining instead of being cut after crimping.

Figure 10:
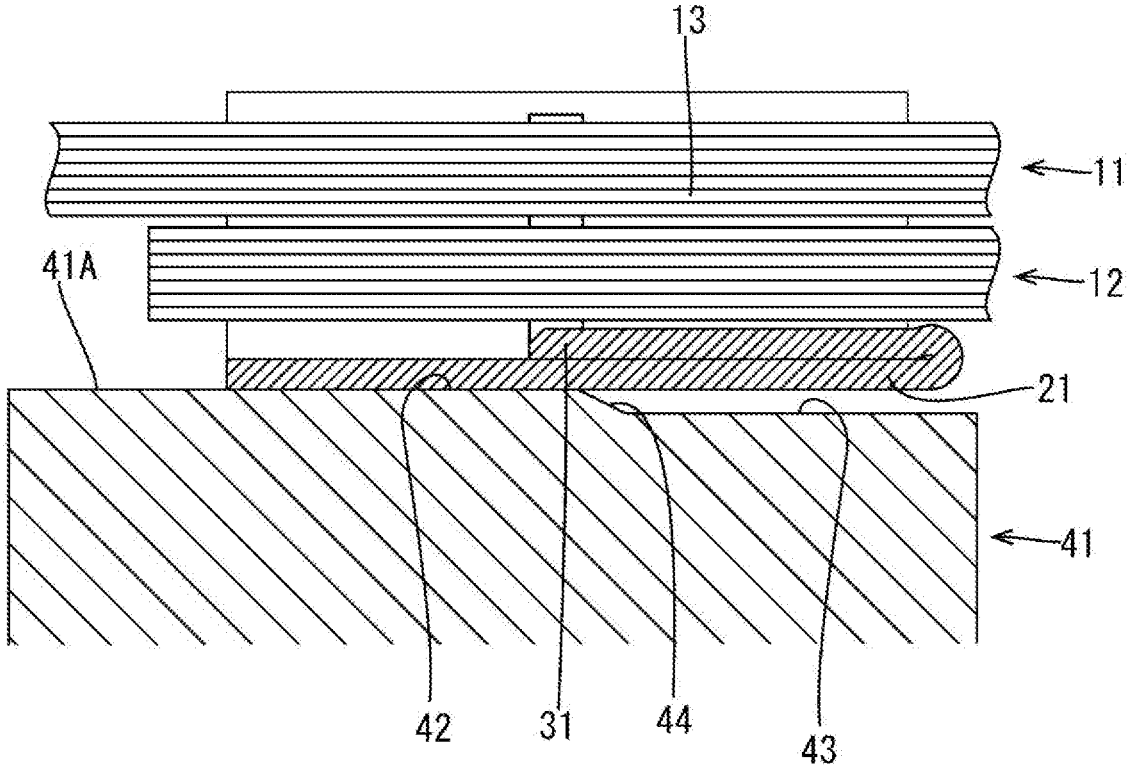
FIG. 10 is a longitudinal sectional view of a state where two electrical wires are arranged on a crimp terminal placed on the lower die.

As shown in FIG. 10, the receiving portion 21 of the crimp terminal 20 is placed on the placement surface 41A of the lower die 41, and the exposed conductor portion 13 of the branch line 12 and the exposed conductor portion 13 of the main line 11 are placed on the receiving portion 21. At this time, a gap is formed between the receiving portion 21 and the second press portion 43.

Figure 11:
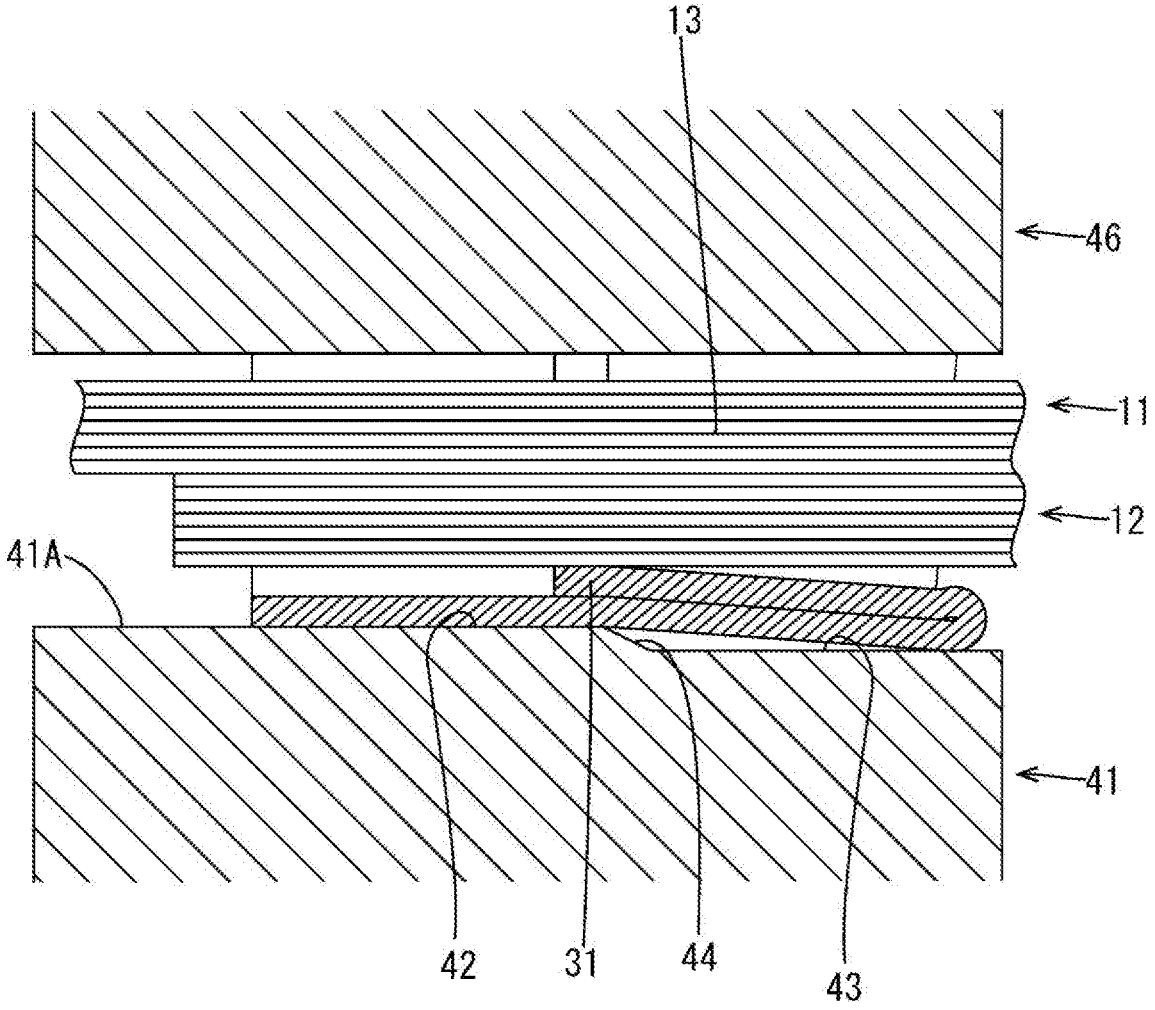
FIG. 11 is a longitudinal sectional view of a step in which the upper die in the state shown in FIG. 10 is lowered to crimp the electrical wires.
Figure 12:
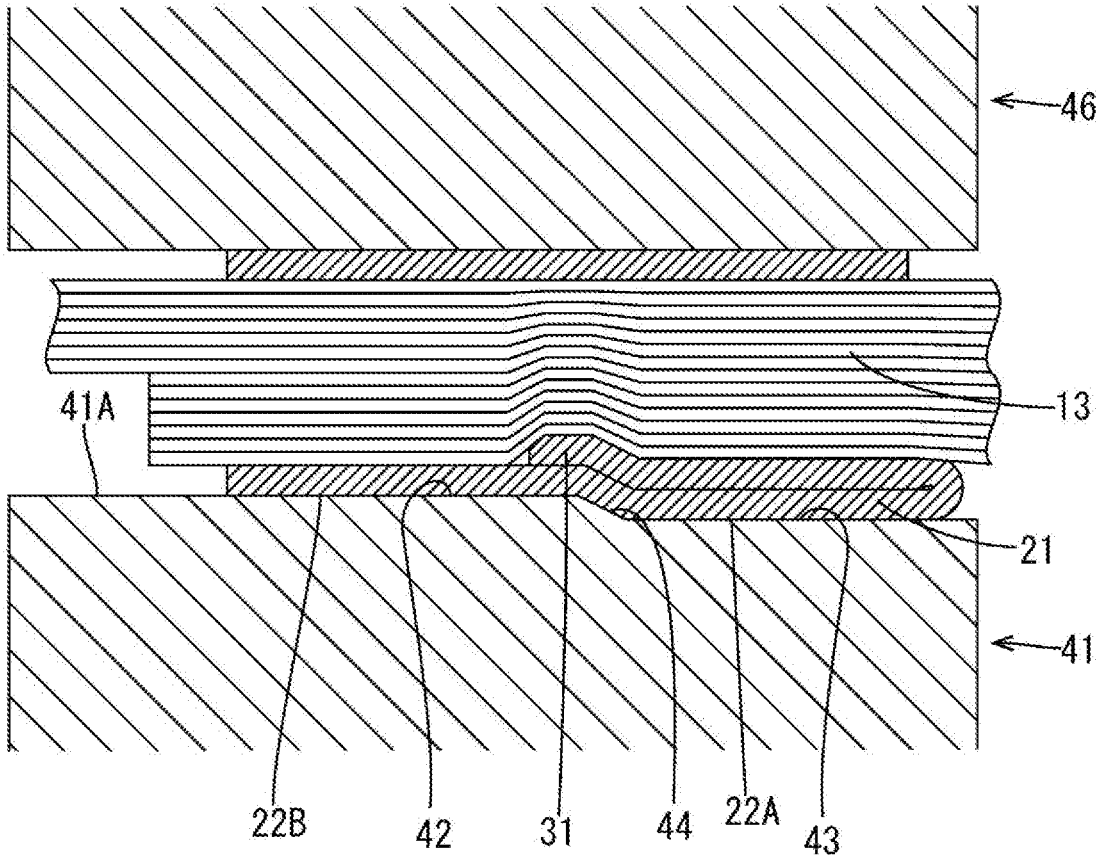
FIG. 12 is a longitudinal sectional view of a step in which the upper die in the state shown in FIG. 11 is further lowered to crimp the electrical wires.
Figure 13:
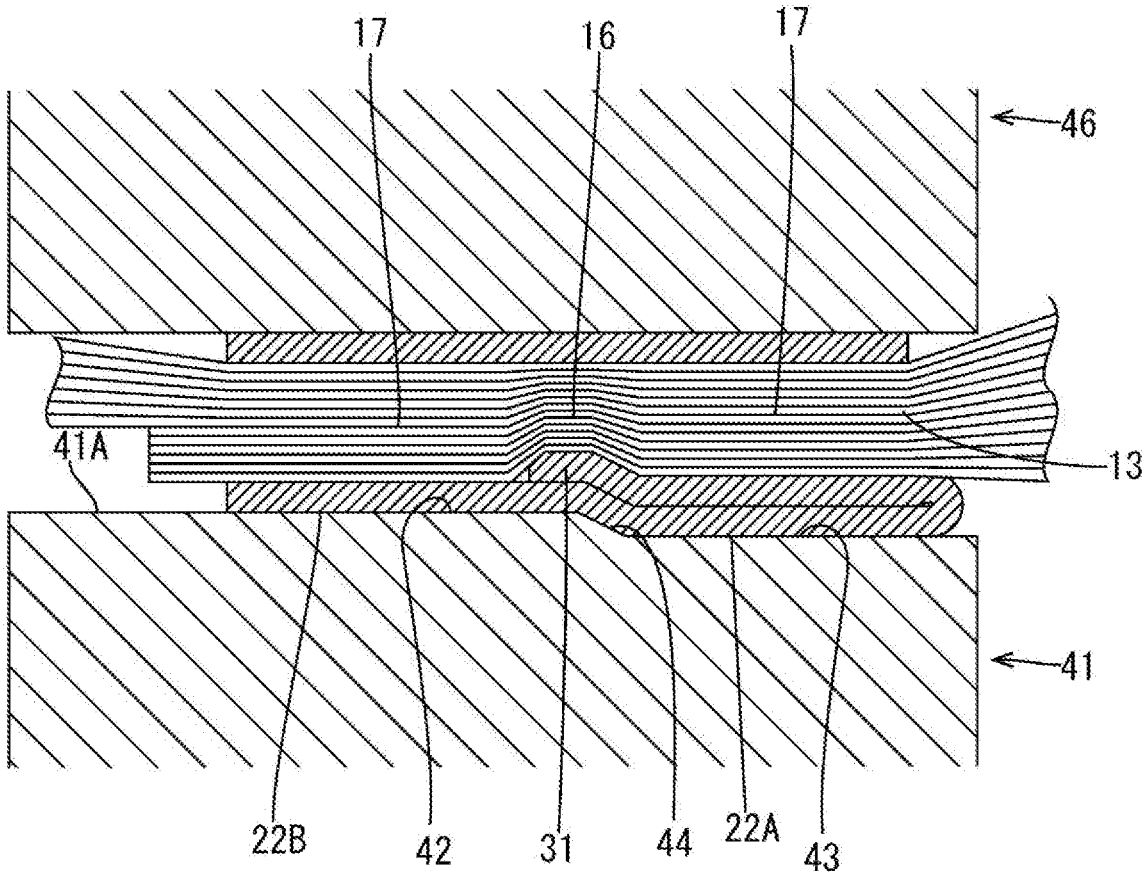
FIG. 13 is a longitudinal sectional view of a step in which the upper die in the state shown in FIG. 12 is further lowered to crimp the electrical wires.

Next, as shown in FIG. 11, the upper die 46 is lowered, and as the upper die 46 and the lower die 41 approach each other, the pair of first barrel portions 24 and the second barrel portion 31 undergo deform so as to be wrapped inward, thus crushing the conductor portions 13 of the main line 11 and the branch line 12. Then, as shown in FIGS. 12 and 13, when the upper die 46 is lowered further, the portion of the receiving portion 21 that is above the second press portion 43 undergoes deformation, and the receiving portion 21 becomes deformed into a shape having a level difference portion and the bulging portion 22A that fit into the level difference portion 44 and the second press portion 43 on the bottom surface side, thus forming the electrical wire with a terminal 10 (FIG. 14).

The following are actions and effects achieved by the present embodiment.

The crimp terminal 20 includes the receiving portion 21 that is for receiving the conductor portions 13 of the electrical wires 11 and 12 and has the end portions 21A and 21B from which the electrical wires 11 and 12 are to be lead out, the pair of first barrel portions 24 that are connected to the receiving portion 21 and are for crimping the conductor portions 13 along with the receiving portion 21, the bend portion 27 that extends from the end portion 21A of the receiving portion 21 and is to be bent so as to be folded over, and the overlap portion 28 that is connected to the bend portion 27 and is to overlap the receiving portion 21.

According to the present embodiment, the bend portion 27 extends from the end portion 21A of the receiving portion 21 on the side from which the electrical wires 11 and 12 are lead out, and therefore it is possible to shorten the path of the bend portion 27 and the overlap portion 28 compared to a configuration in which, for example, the bend portion 27 is folded over in a bypass manner from the end portion of the receiving portion 21 on the side on which the electrical wires 11 and 12 are not lead out. Accordingly, it is possible to simplify the configuration of the crimp terminal 20.

Also, the overlap portion 28 has the extension portion 29 that is connected to and extends from the bend portion 27, and the second barrel portion 31 that is connected to the end portion of the extension portion 29 and extends in a direction orthogonal to (a direction that intersects) the extension portion 29, and the portion of the receiving portion 21 that is connected to the bend portion 27 bulges outward relative to the portion overlapped by the second barrel portion 31.

In the case of crimping the electrical wires 11 and 12, it is preferable that the end portions 21A and 21B of the crimp terminal 20, from which the electrical wires 11 and 12 are lead out, do not highly compress the conductor portions 13, thus suppressing damage to the conductor portions 13 and ensuring force for holding the electrical wires 11 and 12, and it is preferable that a portion of the crimp terminal 20 other than the end portions 21A and 21B from which the electrical wires 11 and 12 are lead out highly compresses the conductor portions 13 on the receiving portion 21, thus ensuring electrical connection between the conductor portions 13 and the crimp terminal 20. However, with a configuration in which the bend portion 27 extends from the end portion 21A on the side where the electrical wires 11 and 12 are lead out, it is not easy to sharply fold over the bend portion 27 from the upper side, and a slightly bulging shape is formed on the upper side (conductor portion 13 side). In this case, there is concern that due to the bulge (protruding portion) on the upper side (conductor portion 13 side) of the bend portion 27, the conductor portions 13 of the electrical wire 11 and 12 will become highly compressed, and the force for holding the electrical wires 11 and 12 will decrease due to damage to the conductor portions 13. According to the present embodiment, the portion of the receiving portion 21 that is connected to the bend portion 27 has the bulging portion 22A that bulges downward (outward) relative to the portion that is overlapped by the second barrel portion 31, and therefore the compression rate can be set higher in the portions of the conductor portions 13 that are placed on the bend portion 27 than in the portions that are placed on the second barrel portion 31, thus making it possible to suppress damage to the portions of the conductor portions 13 that are placed on the bend portion 27 and also suppress a reduction in the force for holding the electrical wires 11 and 12.

Also, the crimp terminal is a splice terminal in which the conductor portions 13 of the electrical wires 11 and 12 are crimped between the receiving portion 21 and the pair of first barrel portions 24.

In the case where the crimp terminal 20 has a splice structure for connecting the electrical wires 11 and 12 to each other, the electrical wires 11 and 12 are lead out from the two end portions of the receiving portion 21, and therefore the conductor portions 13 of the electrical wires 11 and 12 are easily placed on the bend portion 27. According to the above embodiment, it is possible to simplify the configuration of this crimp terminal 20 that has a splice structure.

The crimp terminal 20 is placed on the lower die 41 in state where the conductor portions 13 are placed on the receiving portion 21, and the crimp terminal 20 is clamped between and crimped by the lower die 41 and the upper die 46. The lower die 41 includes the first press portion 42 for mounting and pressing the barrel overlap region 23 of the receiving portion 21 that is overlapped by the second barrel portion 31, and the second press portion 43 that is at a lower position than the first press portion 42 and is for mounting and pressing the region of the receiving portion 21 that is overlapped by the extension portion 29.

According to this configuration, the portions of the conductor portions 13 that are arranged on the extension portion 29 can be compressed less than the portions of the conductor portions 13 that are arranged on the second barrel portion 31, thus making it possible to suppress damage to the portions of the conductor portions 13 that are on the extension portion 29.

Second Embodiment

Figure 18:
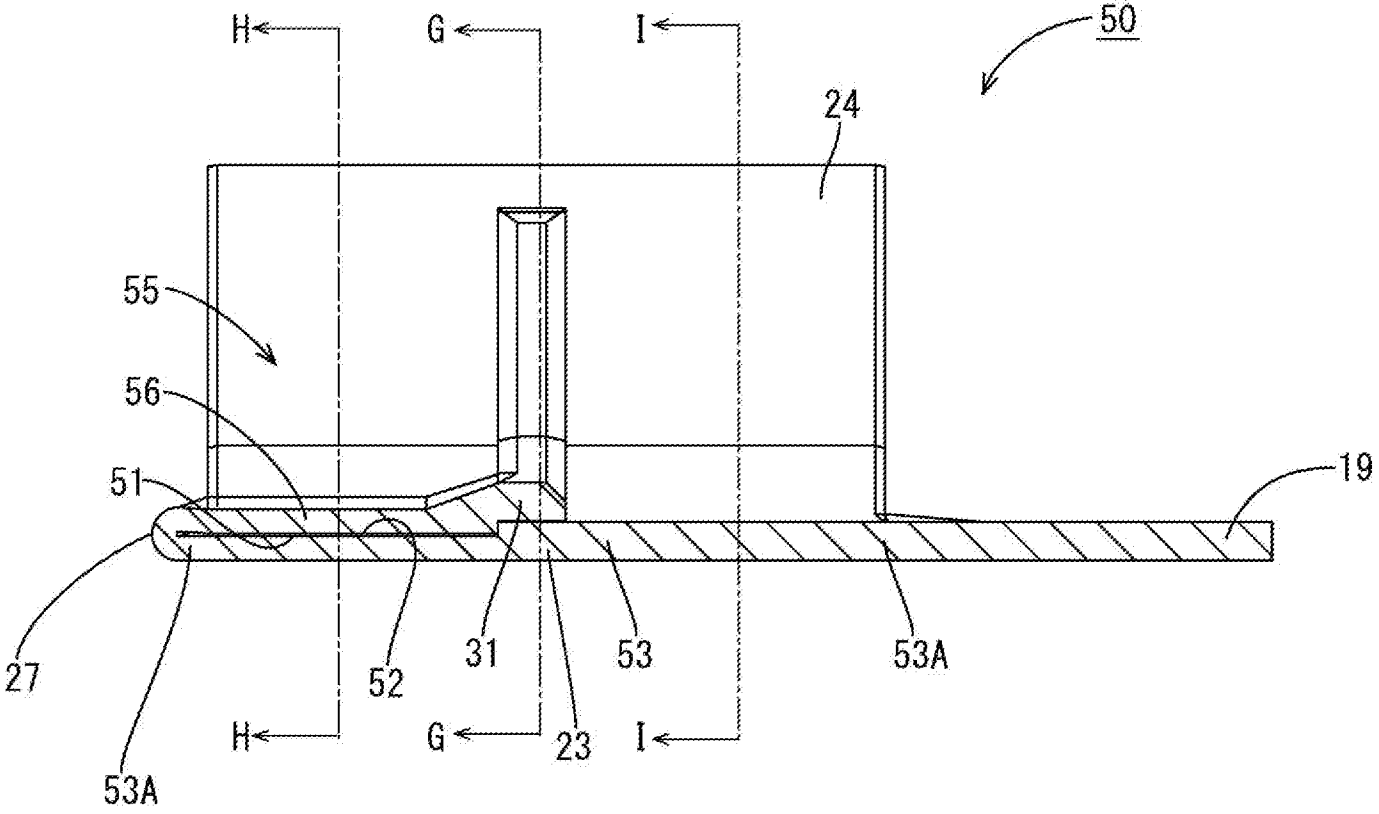
FIG. 18 is a cross-sectional view taken along F-F in FIG. 17.
Figure 19:
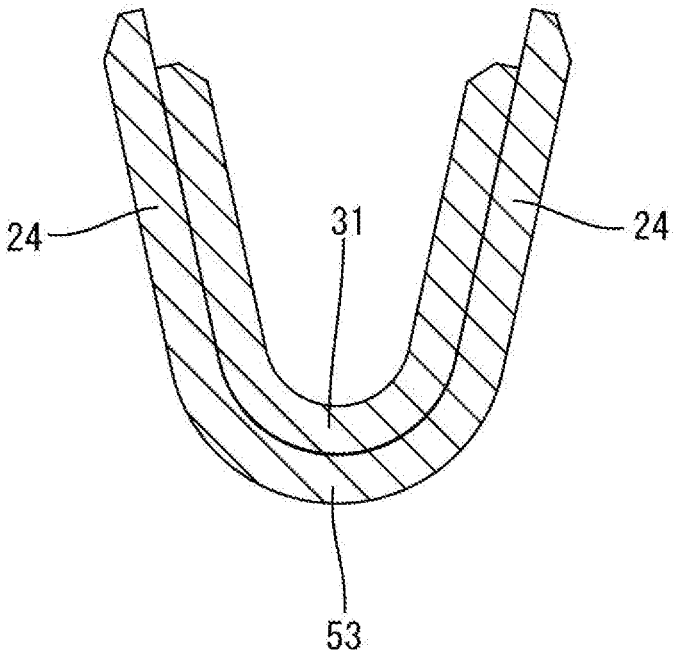
FIG. 19 is a cross-sectional view taken along G-G in FIG. 18.
Figure 20:
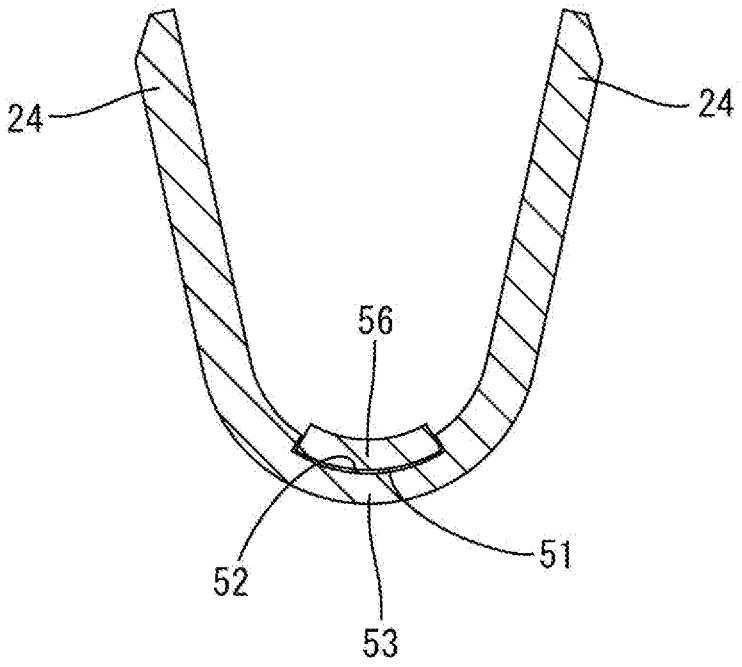
FIG. 20 is a cross-sectional view taken along H-H in FIG. 18.
Figure 21:
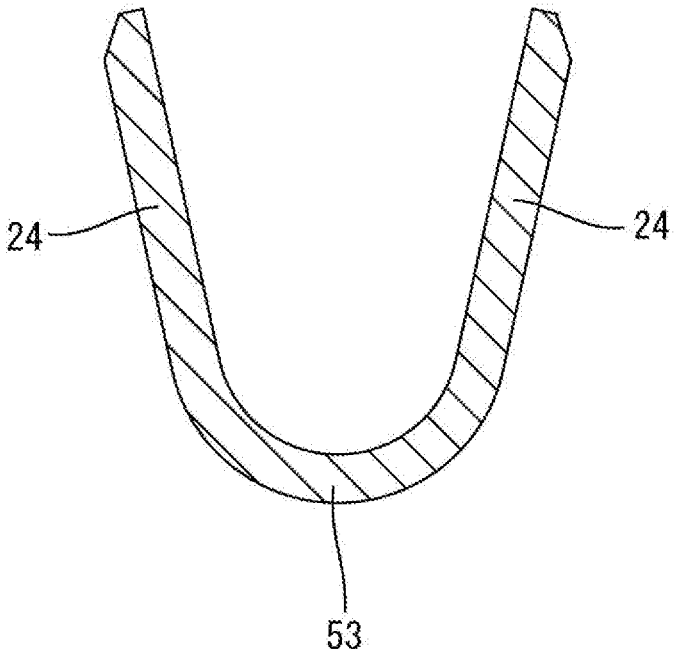
FIG. 21 is a cross-sectional view taken along I-I in FIG. 18.

Next, a second embodiment will be described with reference to FIGS. 16 to 22. As shown in FIG. 18, a crimp terminal 50 of the second embodiment has a configuration in which, in a portion in which a fold-over piece 54 and a receiving portion 53 overlap each other, the thickness is reduced in a region excluding the second barrel portion 31 such that compression is low in the region excluding the second barrel portion 31. In the following description, configurations that are the same as in the first embodiment are denoted by the same reference signs, and descriptions will not be given for them.

The crimp terminal 50 includes a U-shaped receiving portion 53 for receiving the conductor portions 13 of the electrical wires 11 and 12, the pair of first barrel portions 24 that are connected to the receiving portion 53 and are for crimping the conductor portions 13 along with the receiving portion 53, and a fold-over piece 54 that is connected to one end portion 53A of the receiving portion 53 and is for being folded over, and these members are formed integrally. The receiving portion 53 has a curved shape of being concave such that the conductor portions 13 can be placed thereon. At the one end portion 53A of the receiving portion 53 in the front-rear direction (electrical wire extending direction), the main line 11 and the branch line 12 are lead to the outside, and at the other end portion 53B, the conductor portion 13 of the main line 11 and the conductor portion 13 (tip portion) of the branch line 12 are lead to the outside.

The fold-over piece 54 includes the bend portion 27 that extends forward from the end portion 53A of the receiving portion 53 and is bent so as to be folded over rearward, and an overlap portion 55 that is connected to the bend portion 27 and overlaps the receiving portion 53. The bend portion 27 is curved in a U shape, and is connected to the overlap portion 55 that extends parallel with the receiving portion 53. The overlap portion 55 includes an extension portion 56 that extends rearward from the bend portion 27, and the second barrel portion 31 that is connected to the end portion of the extension portion 56 and extends laterally in a direction that is orthogonal to (a direction that intersects) the extension portion 56. The extension portion 56 extends in a straight line with a predetermined width, and connects the bend portion 27 and the second barrel portion 31 to each other.

Figure 22:
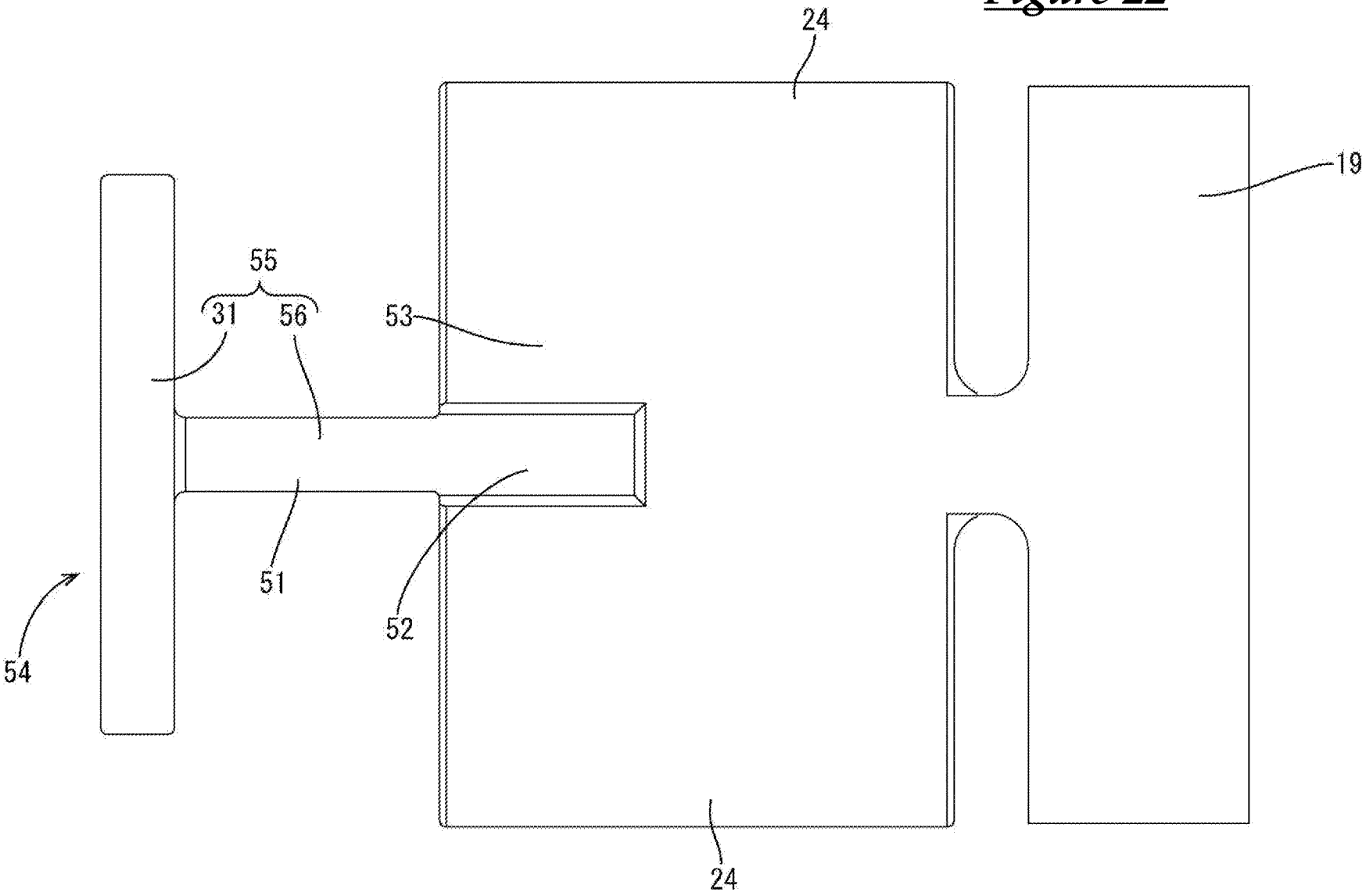
FIG. 22 is an expansion view of the crimp terminal.

As shown in FIGS. 18 and 22, a thin portion 51 is formed in the bend portion 27 and the extension portion 56 of the crimp terminal 50 by performing cutting to obtain a lower thickness than the thickness of the remaining portion of the receiving portion 53 (overall plate thickness). The thin portion 51 is formed in the entirety of the surface on one side of the bend portion 27 and the extension portion 56. Also, a thin portion 52 is formed in a region of the receiving portion 53 that is overlapped by the extension portion 56, by cutting out the surface on the side that is overlapped by the extension portion 56. The thin portion 52 is formed by cutting out a rectangular region that is overlapped by the extension portion 56 on one side of the receiving portion 53. The thickness (plate thickness) of the portions where the thin portions 51 and 52 are formed is approximately half or slightly larger than half of the thickness (plate thickness) of the portions of the receiving portion 53 and the fold-over piece 54 where the thin portions 51 and 52 are not formed, for example. Note that the thickness (plate thickness) the portions where the thin portions 51 and 52 are formed is not limited to this, and it is sufficient that the thickness is at least smaller than the thickness (plate thickness) of the portions where the thin portions 51 and 52 are not formed.

The following are actions and effects achieved by the second embodiment.

The overlap portion 28 of the crimp terminal 50 has the extension portion 29 that is connected to and extends from the bend portion 27, and the second barrel portion 31 that extends in a direction orthogonal to (a direction that intersects) the extension portion 29, and the thickness of at least a portion of respective regions of the bend portion 27, the extension portion 56, and the receiving portion 53 that are overlapped by the extension portion 56 is smaller than the thickness of the barrel overlap region 23 of the receiving portion 21 that is overlapped by the second barrel portion 31.

According to this configuration, it is possible to raise the compression rate in the portions of the conductor portions 13 that are arranged on the bend portion 27 and the extension portion 56, thus making it possible to suppress a reduction in the force for holding the electrical wires 11 and 12 caused by damage to the portions of the conductor portions 13 that overlap the bend portion 27 and the extension portion 56.

Third Embodiment

Next, a third embodiment will be described with reference to FIGS. 23 to 25. In the third embodiment, serrations 61 are provided in the crimp terminal 20 of the first embodiment, and serrations 71 are provided in the crimp terminal 50 of the second embodiment. Other configurations are the same as in the above embodiments, and therefore will not be described.

Figure 23:
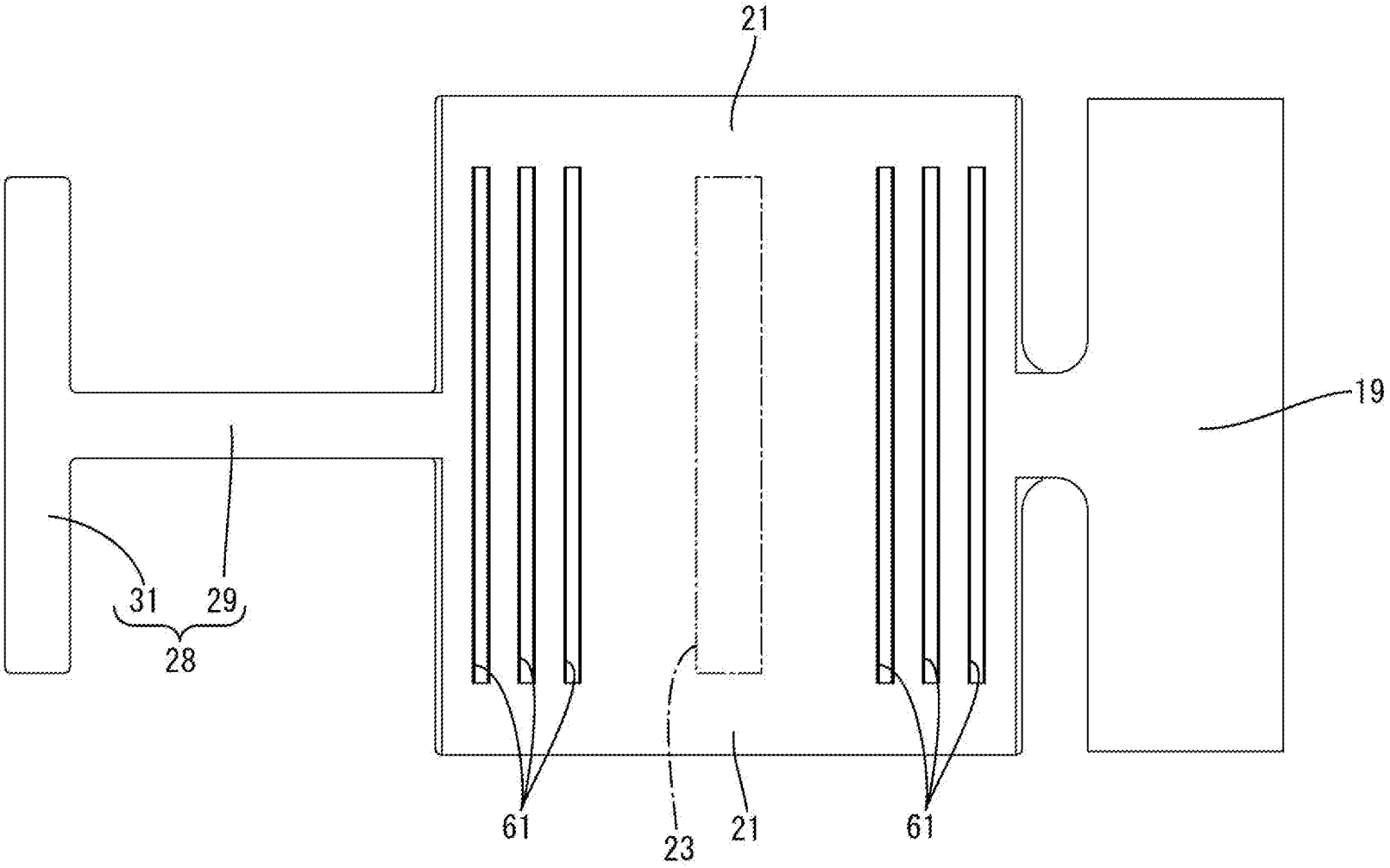
FIG. 23 is an expansion view of a crimp terminal according to a third embodiment.
Figure 24:
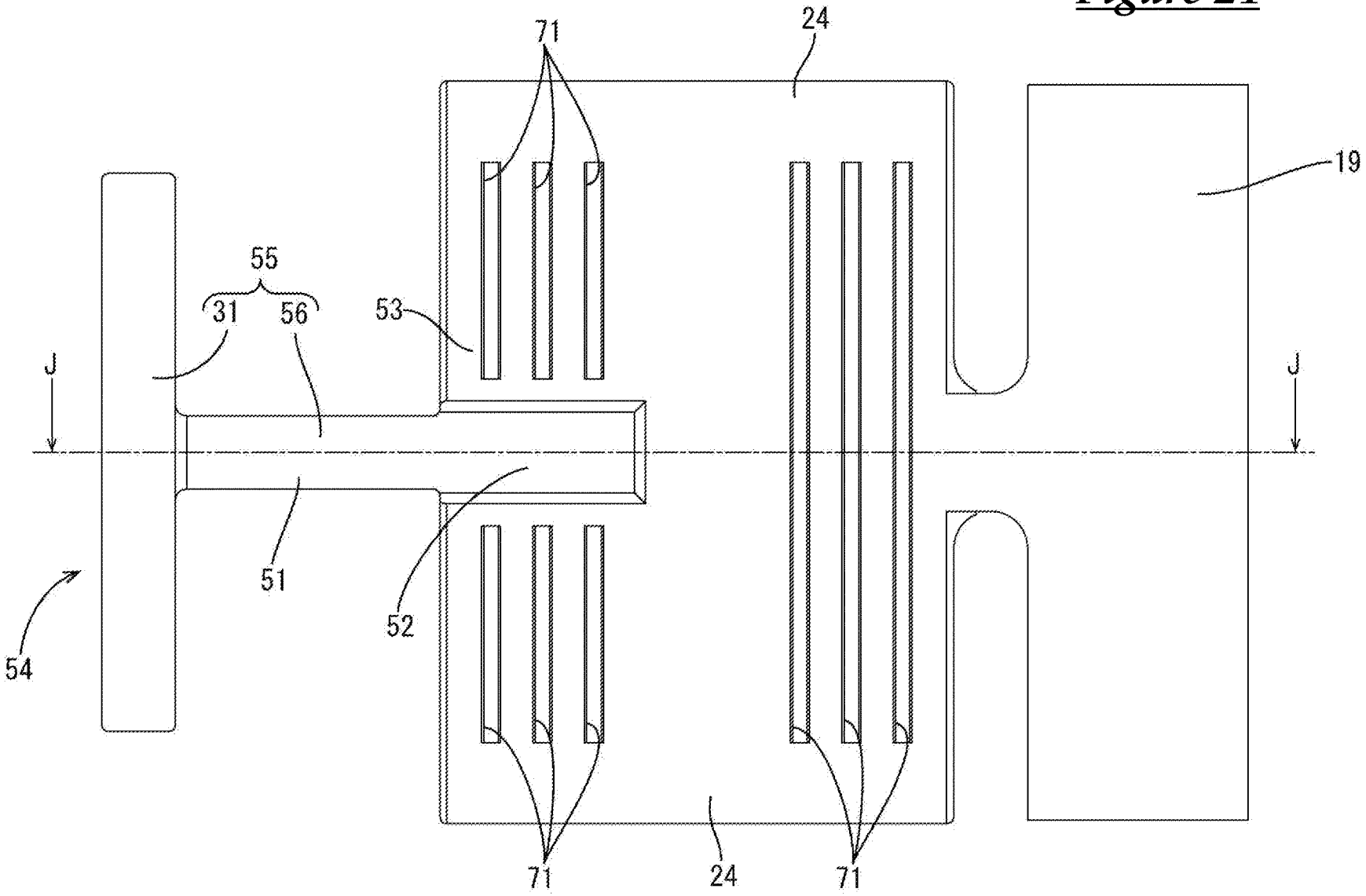
FIG. 24 is an expansion view of the crimp terminal different from FIG. 23.
Figure 25:
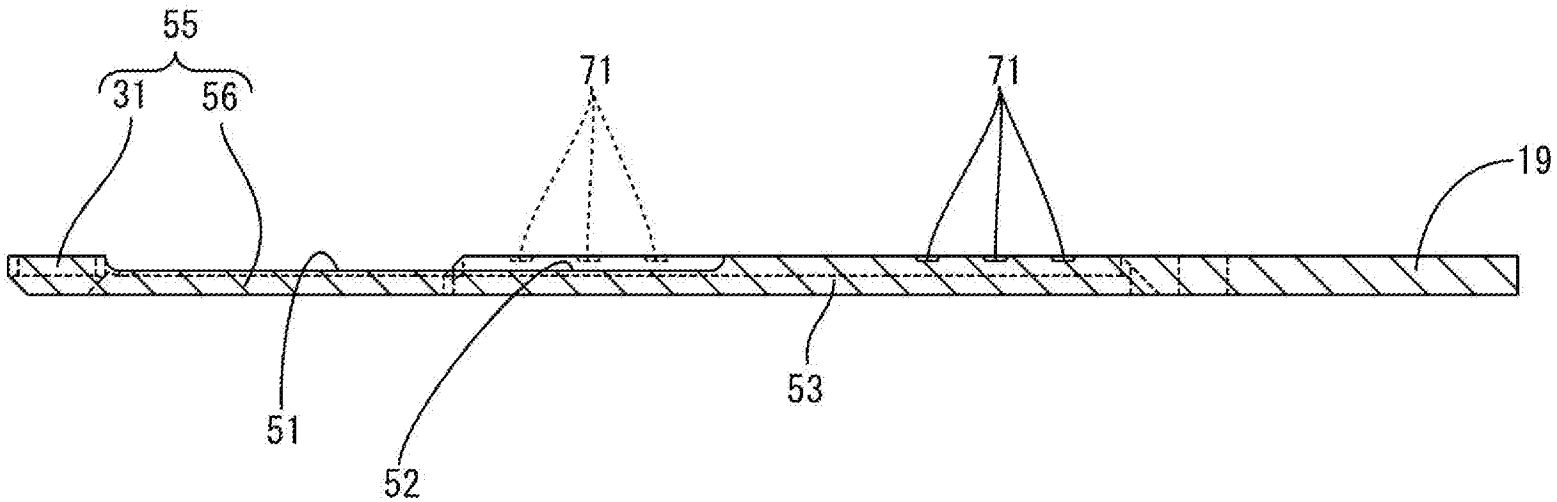
FIG. 25 is a cross-sectional view taken along J-J in FIG. 24.

As shown in FIGS. 23 and 24, the serrations 61 (71) that extend laterally as grooves are provided in the crimp terminal with intervals therebetween in the front-rear direction. The serrations 61 (71) cut into the oxide films of the conductor portions 13 during crimping so as to expose new surfaces.

OTHER EMBODIMENTS

The technology disclosed by the present specification is not intended to be limited to the embodiments described using the above descriptions and drawings, and also encompasses various aspects such as the following.

Although the main line 11 and the branch line 12 are aluminum electrical wires in the above embodiments, the present invention is not limited to this, and either one or both of the main line 11 and the branch line 12 may be an electrical wire made of another metal, such as a copper electrical wire.

The number of main lines 11 and the number of branch lines 12 are not limited to the numbers described in the above embodiments, and can be changed as appropriate.

Although the crimp terminal is a splice terminal in which the main line 11 and the branch line 12 are crimped in a side-by-side arrangement in the above embodiments, the present invention is not limited to this. For example, the crimp terminal may be a male or female crimp terminal that is crimped to terminal portions of the electrical wires 11 and 12 and connected to a partner terminal.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A crimp terminal comprising:

a receiving portion that is to receive a conductor portion of an electrical wire, and has an end portion from which the electrical wire is to be lead out;

a pair of first barrel portions that are connected to the receiving portion and are to crimp the conductor portion along with the receiving portion; and a fold-over piece that includes an overlap portion and a bend portion that extends from the end portion of the receiving portion and is to be bent so as to be folded over;

wherein the overlap portion includes a second barrel portion and an extension portion that is connected to the bend portion, the second barrel portion extends from the extension portion in a direction that intersects the extension portion, and the fold-over piece is configured to be folded over and bent at the bend portion so that the extension portion overlaps the receiving portion and the second barrel portion overlaps the pair of first barrel portions.

2. The crimp terminal according to claim 1, wherein the extension portion extends from the bend portion, and a portion of the receiving portion that is connected to the bend portion bulges outward relative to a portion of the receiving portion that is overlapped by the second barrel portion.

3. The crimp terminal according to claim 1, wherein the extension portion extends from the bend portion, and a thickness of the bend portion is smaller than a thickness of a portion of the receiving portion that is overlapped by the second barrel portion.

4. The crimp terminal according to claim 1, wherein conductor portions of a plurality of the electrical wires are crimped between the receiving portion and the pair of first barrel portions.

5. An electrical wire with a terminal comprising:

an electrical wire and the crimp terminal according to claim 1, a conductor portion of the electrical wire being crimped between the receiving portion and the pair of first barrel portions.

* * * * *